US008590314B2

(12) United States Patent
McMahan et al.

(10) Patent No.: US 8,590,314 B2
(45) Date of Patent: Nov. 26, 2013

(54) COMBUSTOR LINER HELICAL COOLING APPARATUS

(75) Inventors: Kevin Weston McMahan, Greer, SC (US); Ronald James Chila, Greer, SC (US)

(73) Assignee: General Electric Company, Schenectady, NY (US)

( * ) Notice: Subject to any disclaimer, the term of this patent is extended or adjusted under 35 U.S.C. 154(b) by 809 days.

(21) Appl. No.: 12/757,610

(22) Filed: Apr. 9, 2010

(65) Prior Publication Data

US 2011/0247341 A1 Oct. 13, 2011

(51) Int. Cl.
*F02C 1/00* (2006.01)
*F02G 3/00* (2006.01)

(52) U.S. Cl.
USPC ..... 60/752; 60/753; 60/754; 60/755; 60/756; 60/757; 60/758; 60/759; 60/760

(58) Field of Classification Search
USPC ..... 60/752–760
See application file for complete search history.

(56) References Cited

U.S. PATENT DOCUMENTS 4,543,781 A * 10/1985 Rice ..... 60/804
5,724,816 A * 3/1998 Ritter et al. ..... 60/752
5,737,922 A * 4/1998 Schoenman et al. ..... 60/752
6,282,905 B1 * 9/2001 Sato et al. ..... 60/752
7,010,921 B2 * 3/2006 Intile et al. ..... 60/752
8,307,654 B1 * 11/2012 Liang ..... 60/752
2004/0050059 A1 3/2004 Bunker
2004/0079082 A1 4/2004 Bunker
2005/0044857 A1 3/2005 Glezer et al.
2010/0005803 A1 1/2010 Tu et al.

FOREIGN PATENT DOCUMENTS

JP 2002155758 A * 5/2002 ..... F02C 7/18

OTHER PUBLICATIONS

Search Report and Opinion issued Oct. 26. 2011 in corresponding EP Application No. 11161628.0.

* cited by examiner

*Primary Examiner* — Gerald L Sung
*Assistant Examiner* — Craig Kim
(74) *Attorney, Agent, or Firm* — Dority & Manning, PA

(57) ABSTRACT

A combustor liner is provided. The combustor liner may include an upstream portion and a downstream end portion. The upstream portion may have a radius and a length along a generally longitudinal axis. The downstream end portion may have a radius and a length along the generally longitudinal axis. The downstream end portion may define a plurality of channels. Each of the plurality of channels may extend helically through the length of the downstream end portion. Each of the plurality of channels may be configured to flow an air flow therethrough, cooling the downstream end portion.

20 Claims, 7 Drawing Sheets

FIG. —1—

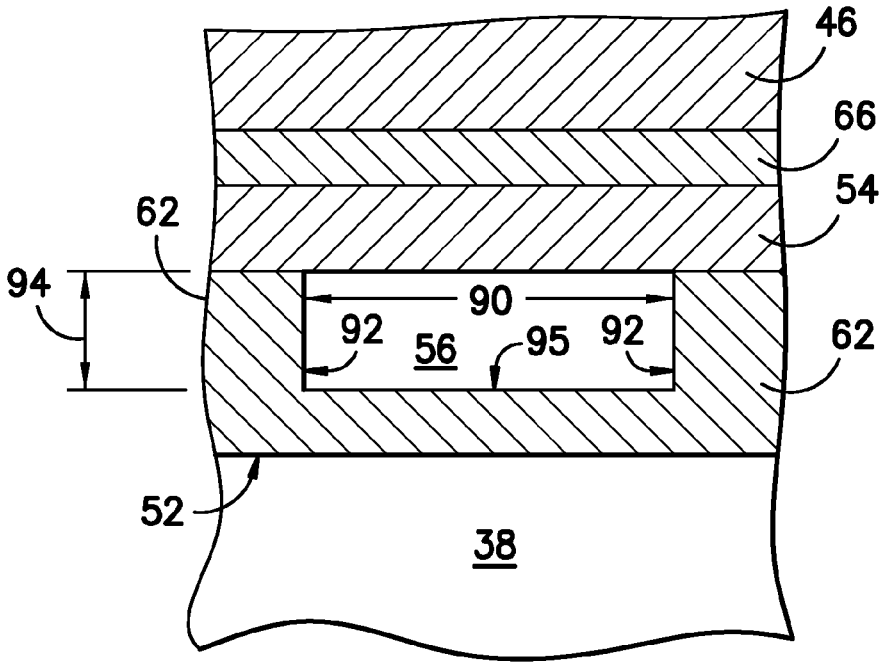
FIG. –6–
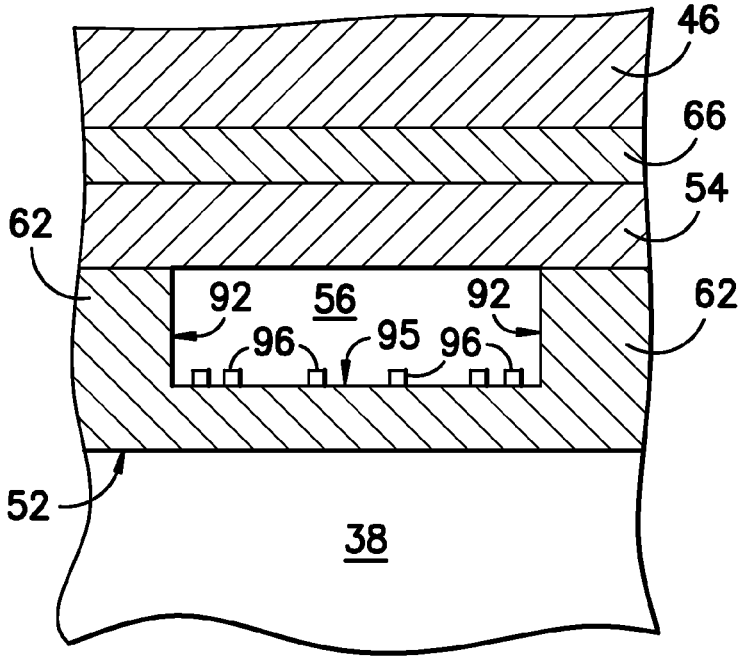
FIG. –7–

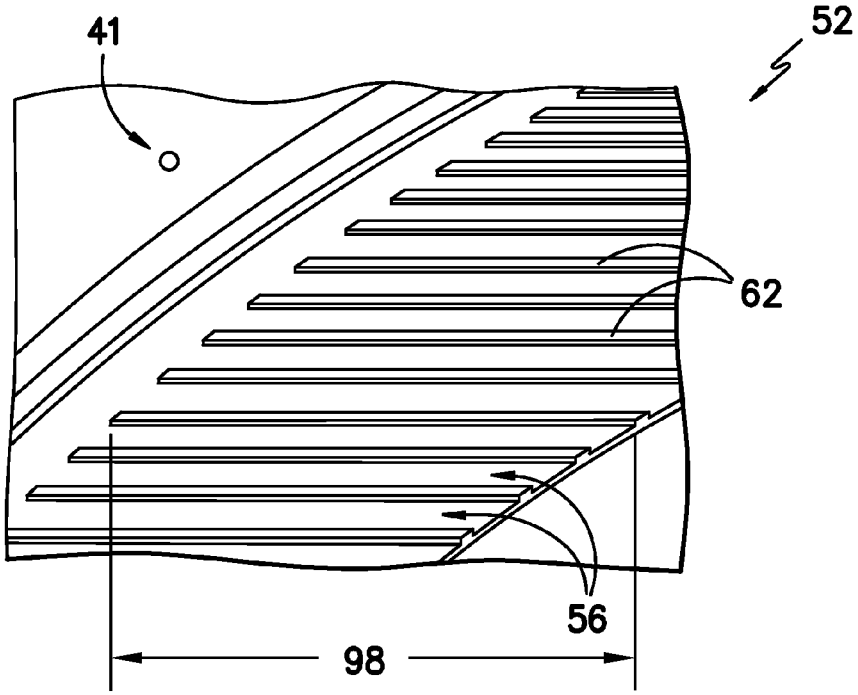
FIG. –8–
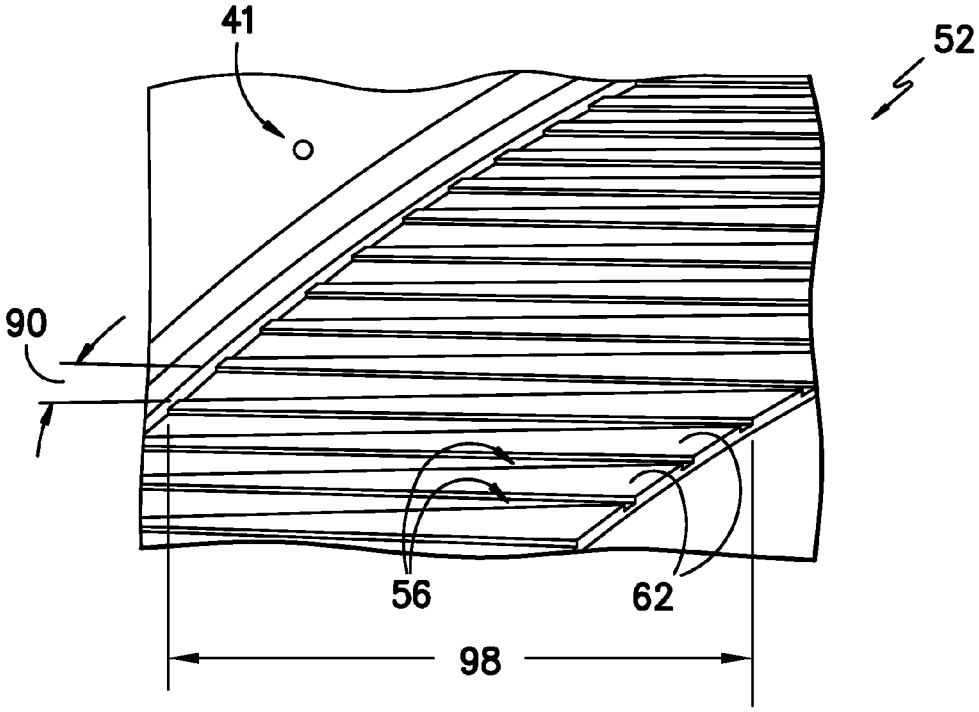
FIG. –9–

COMBUSTOR LINER HELICAL COOLING APPARATUS

FIELD OF THE INVENTION

The subject matter disclosed herein relates generally to gas turbine systems, and more particularly to apparatus for cooling a combustor liner in a combustor of a gas turbine system.

BACKGROUND OF THE INVENTION

Gas turbine systems are widely utilized in fields such as power generation. A conventional gas turbine system includes a compressor, a combustor, and a turbine. During operation of the gas turbine system, various components in the system are subjected to high temperature flows, which can cause the components to fail. Since higher temperature flows generally result in increased performance, efficiency, and power output of the gas turbine system, the components that are subjected to high temperature flows must be cooled to allow the gas turbine system to operate at increased temperatures.

One gas turbine system component that should be cooled is the combustor liner. As high temperature flows, caused by combustion of an air-fuel mix within the combustor, are directed through the combustor, the high temperature flows heat the combustor liner, which could cause the combustor liner to fail. Specifically, the downstream end portion of the combustor liner, which in many combustors has a smaller radius than the combustor liner in general, may be a life-limiting section of the combustor liner which may fail due to exposure to high temperature flows. Thus, in order to increase the life of the combustor liner, the downstream end portion must be cooled.

Various strategies are known in the art for cooling the combustor liner. For example, a portion of the air flow provided from the compressor through fuel nozzles into the combustor may be siphoned to linear, axial channels defined in the downstream end portion of the combustor liner. As the air flow is directed through the axial channels in the direction of flow of the hot gas, the air flow may cool the downstream end portion. However, cooling of the downstream end portion by the air flow within the axial channels is generally limited by the length of the downstream end portion of the combustor liner, which defines the length of the axial channels. Thus, the axial channels may limit the effectiveness of the air flow in cooling the downstream end portion.

Thus, a combustor liner cooling apparatus is desired in the art. For example, an apparatus to cool the downstream end portion of the combustor liner may be advantageous. Further, a downstream end portion of a combustor liner with cooling channels that exceed that length of the downstream end portion, increasing the cooling of the downstream end portion, may be advantageous.

BRIEF DESCRIPTION OF THE INVENTION

Aspects and advantages of the invention will be set forth in part in the following description, or may be obvious from the description, or may be learned through practice of the invention.

In one embodiment, a combustor liner is provided. The combustor liner may include an upstream portion and a downstream end portion. The upstream portion may have a radius and a length along a generally longitudinal axis. The downstream end portion may have a radius and a length along the generally longitudinal axis. The downstream end portion may define a plurality of channels. Each of the plurality of channels may extend helically through the length of the downstream end portion. Each of the plurality of channels may be configured to flow an air flow therethrough, cooling the downstream end portion.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWING

A full and enabling disclosure of the present invention, including the best mode thereof, directed to one of ordinary skill in the art, is set forth in the specification, which makes reference to the appended figures, in which:

FIG. 6 is a partial cross-sectional view of one embodiment of the channels of the present disclosure taken along line 6-6 of FIG. 5;

FIG. 7 is a partial cross-sectional view of another embodiment of the channels of the present disclosure taken along line 7-7 of FIG. 5;

FIG. 8 is a partial perspective view of another embodiment of the combustor liner of the present disclosure; and FIG. 9 is a partial perspective view of yet another embodiment of the combustor liner of the present disclosure.

DETAILED DESCRIPTION OF THE INVENTION

Figure 1:
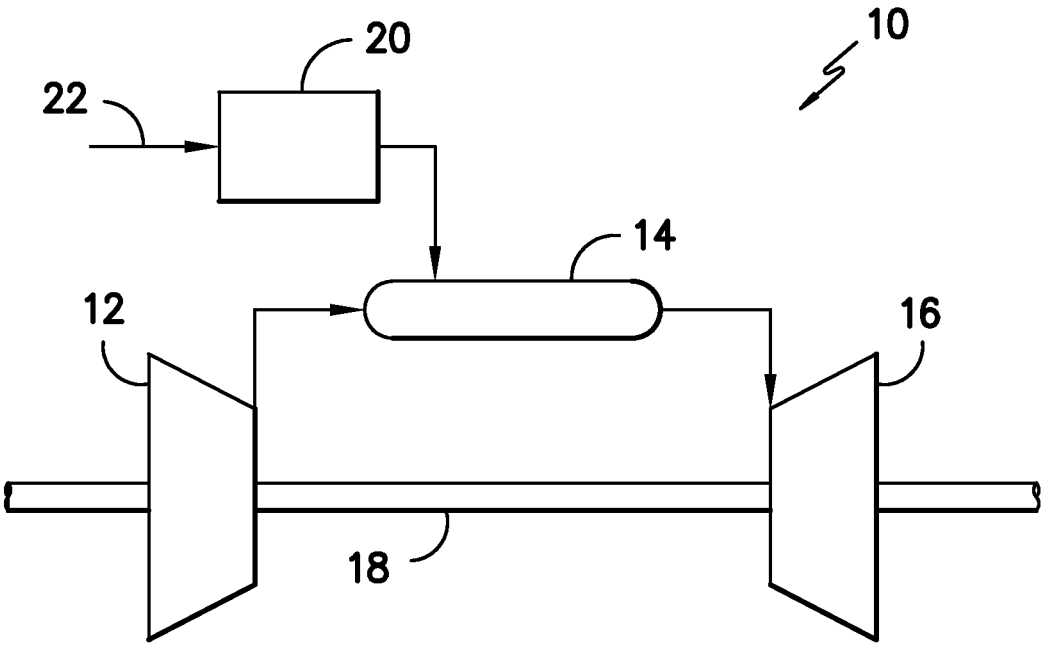
FIG. 1 is a schematic illustration of a gas turbine system.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 is a schematic diagram of a gas turbine system 10. The system 10 may include a compressor 12, a combustor 14, a turbine 16, and a fuel nozzle 20. Further, the system 10 may include a plurality of compressors 12, combustors 14, turbines 16, and fuel nozzles 20. The compressor 12 and turbine 16 may be coupled by a shaft 18. The shaft 18 may be a single shaft or a plurality of shaft segments coupled together to form shaft 18.

The gas turbine system 10 may use liquid or gas fuel, such as natural gas or a hydrogen rich synthetic gas, to run the system 10. For example, the fuel nozzles 20 may intake a fuel supply 22 and an air flow 72 (see FIG. 2) from a discharge plenum 31 of the compressor 12, mix the fuel supply 22 with the air flow 72 to create an air-fuel mix, and discharge the air-fuel mix into the combustor 14. The air-fuel mix accepted by the combustor 14 may combust in a combustion chamber 38 within combustor 14, thereby creating a hot pressurized exhaust gas, or hot gas flow 73. The combustor 14 may direct the hot gas flow 73 through a hot gas path 39 within the combustor 14 into the turbine 16. As the hot gas flow 73 passes through the turbine 16, the turbine 16 may cause the shaft 18 to rotate. The shaft 18 may be connected to various components of the turbine system 10, including the compressor 12. Thus, rotation of the shaft 18 may cause the compressor 12 to operate, thereby compressing the air flow 72.

Thus, in operation, air flow 72 may enter the turbine system 10 and be pressurized in the compressor 12. The air flow 72 may then be mixed with fuel supply 22 for combustion within combustor 14. For example, the fuel nozzles 20 may inject a fuel-air mixture into the combustor 14 in a suitable ratio for optimal combustion, emissions, fuel consumption, and power output. The combustion may generate hot gas flow 73, which may be provided through the combustor 14 to the turbine 16.

Figure 2:
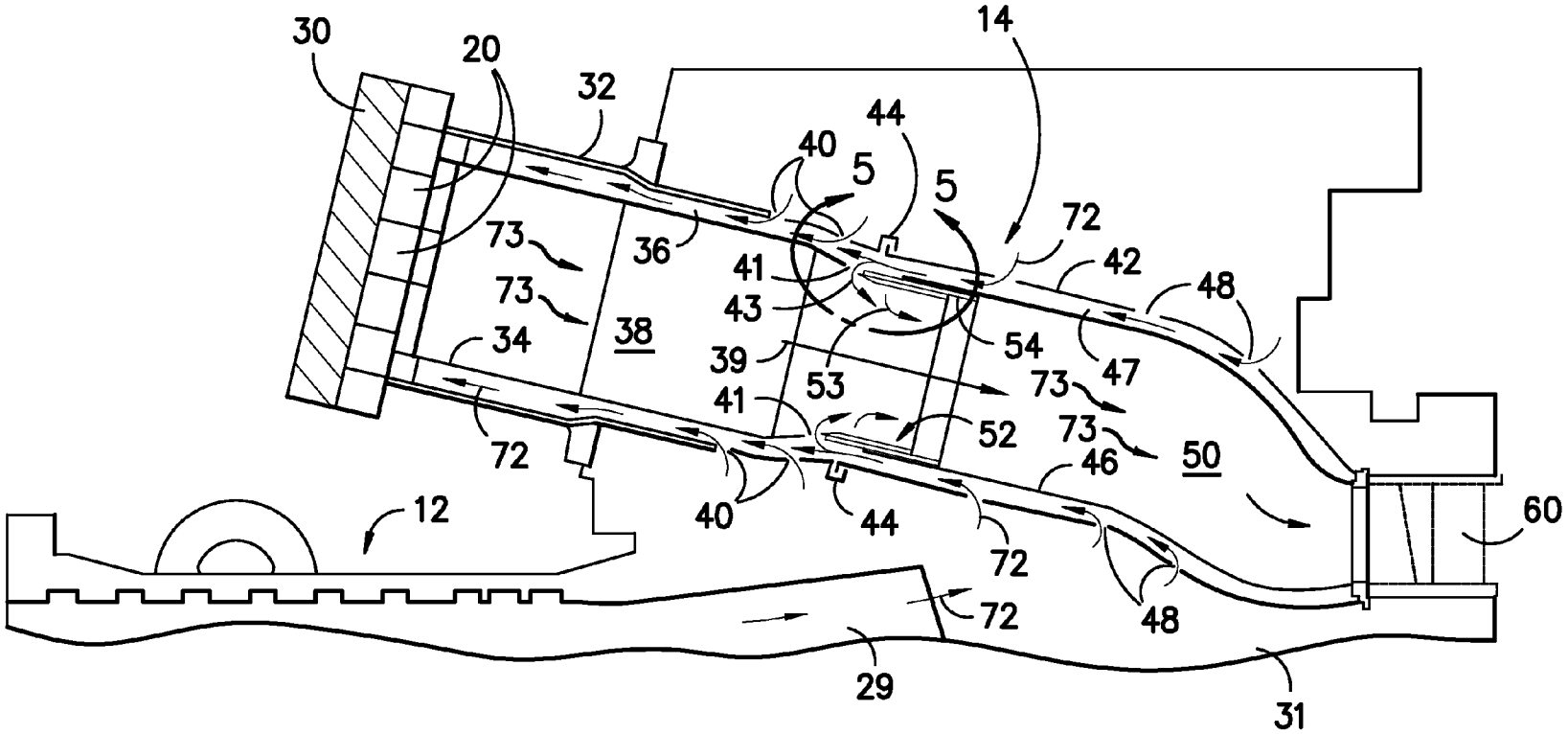
FIG. 2 is a side cutaway view of one embodiment of various components of the gas turbine system of the present disclosure.

As illustrated in FIG. 2, the combustor 14 is generally fluidly coupled to the compressor 12 and the turbine 16. The compressor 12 may include a diffuser 29 and a discharge plenum 31 that are coupled to each other in fluid communication, so as to facilitate the channeling of air to the combustor 14. For example, after being compressed in the compressor 12, air flow 72 may flow through the diffuser 29 and be provided to the discharge plenum 31. The air flow 72 may then flow from the discharge plenum 31 through the fuel nozzles 20 to the combustor 14.

The combustor 14 may include a cover plate 30 at the upstream end of the combustor 14. The cover plate 30 may at least partially support the fuel nozzles 20 and provide a path through which air flow 72 and fuel supply 22 may be directed to the fuel nozzles 20.

The combustor 14 may comprise a hollow annular wall configured to facilitate air flow 72. For example, the combustor 14 may include a combustor liner 34 disposed within a flow sleeve 32. The arrangement of the combustor liner 34 and the flow sleeve 32, as shown in FIG. 2, is generally concentric and may define an annular passage or air flow path 36 therebetween. In certain embodiments, the flow sleeve 32 and the combustor liner 34 may define a first or upstream hollow annular wall of the combustor 14. The flow sleeve 32 may include a plurality of inlets 40, which provide a flow path for at least a portion of the air flow 72 from the compressor 12 through the discharge plenum 31 into the annular passage or air flow path 36. In other words, the flow sleeve 32 may be perforated with a pattern of openings to define a perforated annular wall. The interior of the combustor liner 34 may define a substantially cylindrical or annular combustion chamber 38 and at least partially define a hot gas path 39 through which hot gas flow 73 may be directed.

Downstream from the combustor liner 34 and the flow sleeve 32, an impingement sleeve 42 may be coupled to the flow sleeve 32. The flow sleeve 32 may include a mounting flange 44 configured to receive a portion of the impingement sleeve 42. A transition piece 46 may be disposed within the impingement sleeve 42, such that the impingement sleeve 42 surrounds the transition piece 46. A concentric arrangement of the impingement sleeve 42 and the transition piece 46 may define an annular passage or air flow path 47 therebetween. The impingement sleeve 42 may include a plurality of inlets 48, which may provide a flow path for at least a portion of the air flow 72 from the compressor 12 through the discharge plenum 31 into the air flow path 47. In other words, the impingement sleeve 42 may be perforated with a pattern of openings to define a perforated annular wall. An interior cavity 50 of the transition piece 46 may further define hot gas path 39 through which hot gas flow 73 from the combustion chamber 38 may be directed into the turbine 16.

As shown, the air flow path 47 is fluidly coupled to the air flow path 36. Thus, together, the air flow paths 47 and 36 define an air flow path configured to provide air flow 72 from the compressor 12 and the discharge plenum 31 to the fuel nozzles 20, while also cooling the combustor 14.

The transition piece 46 may be coupled to combustor liner 34 generally about a downstream end portion 52. An annular wrapper 54 and a sealing ring 66 may be disposed between the downstream end portion 52 and the transition piece 46. The sealing ring 66 may provide a seal between the combustor liner 34 and the transition piece 46. For example, the sealing ring 66 may seal the outer surface of the annular wrapper 54 to the inner surface of the transition piece 46.

As discussed above, the turbine system 10, in operation, may intake an air flow 72 and provide the air flow 72 to the compressor 12. The compressor 12, which is driven by the shaft 18, may rotate and compress the air flow 72. The compressed air flow 72 may then be discharged into the diffuser 29. The majority of the compressed air flow 72 may then be discharged from the compressor 12, by way of the diffuser 29, through the discharge plenum 31 and into the combustor 14. Additionally, a small portion (not shown) of the compressed air flow 72 may be channeled downstream for cooling of other components of the turbine engine 10.

A portion of the compressed air within the discharge plenum 31 may enter the air flow path 47 by way of the inlets 48. The air flow 72 in the air flow path 47 may then be channeled upstream through air flow path 36, such that the air flow is directed over the downstream end portion 52 of the combustor liner 34. Thus, an air flow path is defined in the upstream direction by air flow path 47 (farmed by impingement sleeve 42 and transition piece 46) and air flow path 36 (formed by flow sleeve 32 and combustor liner 34).

A portion of the air flow 72 flowing in the upstream direction may be directed from air flow path 47 though the annular wrapper 54 to the downstream end portion 52 of the combustor liner 34. For example, a plurality of inlet passages 68 (see FIGS. 3 and 5) defined by the annular wrapper 54 may provide a flow path through the annular wrapper 54 to the downstream end portion 52.

The air flow 72 that is not directed through the annular wrapper 54 may continues to flow upstream through air flow path 36 toward the cover plate 30 and fuel nozzles 20. Accordingly, air flow path 36 may receive air flow 72 from both air flow path 47 and inlets 40. As shown in FIG. 2, a portion 43 of the air flow 72 within the air flow path 36 may be directed into one or more bypass openings 41 on the combustor liner 34. The bypass openings 41 may extend radially through the combustor liner 34 and provide a direct flow path into the combustion chamber 38 that bypasses the channels 56 defined in the downstream end portion 52. The air flow 43 that flows into the combustion chamber 38 through the bypass openings 41 may provide a cooling film along the inner surface of the combustor liner 34. The remaining air flow 72 through the air flow path 36 may then be channeled upstream towards the fuel nozzles 20, wherein the air flow 72 may be mixed with fuel supply 22 and ignited within the combustion chamber 38 to create hot gas flow 73. The hot gas flow 73 may be channeled through the combustion chamber 38 along the hot gas path 39 into the transition piece cavity 50 and through a turbine nozzle 60 to the turbine 16.

Figure 3:
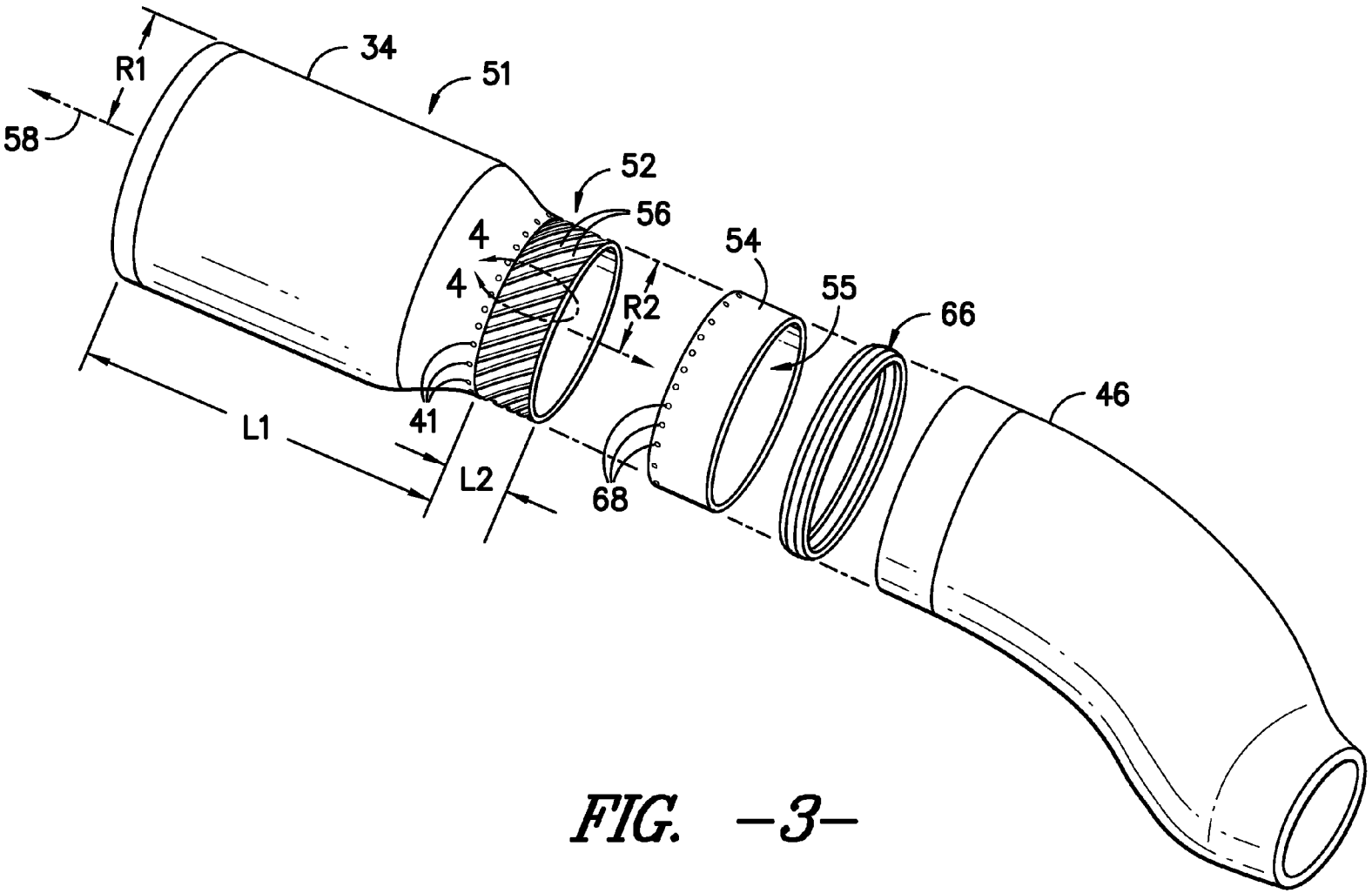
FIG. 3 is an exploded perspective view of one embodiment of various components of the combustor of the present disclosure.

FIG. 3 illustrates an exploded perspective view of one embodiment of various components of the combustor 14 of the present disclosure. Particularly, FIG. 3 is intended to provide a better understanding of the relationship between the combustor liner 34, the annular wrapper 54, and the transition piece 46. As shown, the combustor liner 34 may include an upstream portion 51 and a downstream end portion 52. The upstream portion 51 may have an axial length L1 when measured along a longitudinal axis 58. The downstream end portion 52 may have an axial length L2 when measured along the longitudinal axis 58. In the illustrated embodiment, a radius R1 of the upstream portion 51 of the combustor liner 34 may be greater than a radius R2 of the downstream end portion 52 of the combustor liner 34. In other embodiments, however, the radii R1 and R2 may be equal, or the radius R2 may be greater than the radius R1. Further, it should be understood that the radii R1 and R2 may taper throughout the lengths L1 and L2, or throughout a portion of the lengths L1 and L2, of the upstream portion 51 and downstream end portion 52, respectively. For example, the radii R1 and R2 may be reduced throughout the lengths L1 and L2, or throughout a portion of the lengths L1 and L2, in the direction of hot gas flow 73 or air flow 84, which will be discussed in detail below. Alternately, the radii R1 and R2 may be enlarged throughout the lengths L1 and L2, or throughout a portion of the lengths L1 and L2, in the direction of hot gas flow 73 or air flow 84. Further, radius R1 may be tapered while R2 remains constant, or R2 may be tapered while R1 remains constant.

The length L2 of the downstream end portion 52 of the combustor liner 34 may generally be less than the length L1 of the upstream portion 51 of the combustor liner 34. Further, in one embodiment, the length L2 of the downstream end portion 52 may be approximately 10-20 percent of the total length (L1+L2) of the combustor liner 34. However, it should be appreciated that in other embodiments, the length L2 could be greater than 20 percent or less than 10 percent of the total length of the combustor liner 34. For example, in other embodiments, the longitudinal length L2 of the downstream end portion 52 may be at least less than approximately 5, 10, 15, 20, 25, 30, or 35 percent of the total length of the combustor liner 34.

The annular wrapper 54 may be configured to mate with the combustor liner 34 generally about the downstream end portion 52 in a telescoping, coaxial, or concentric overlapping relationship. The transition piece 46 may be coupled to the combustor liner 34 generally about the downstream end portion 52 and the annular wrapper 54. The sealing ring 66 may be disposed between the annular wrapper 54 and the transition piece 46 to facilitate the coupling. For example, the sealing ring 66 may provide a seal between the combustor liner 34 and the transition piece 46. As shown, the annular wrapper 54 may define a plurality of inlets passages 68 generally near the upstream end of the annular wrapper 54. In the illustrated embodiment, the inlet passages 68 are depicted as a plurality of openings disposed circumferentially (relative to the axis 58) about the upstream end of the annular wrapper 54 and extending radially therethrough. However, it should be understood that the inlet passages 68 may be defined in any arrangements and at any locations on the annular wrapper 54. The openings defined by the inlet passages 68 may include holes, slots, or a combination of holes and slots, for example. Further, the openings defined by the inlet passages 68 may be any openings or passages known in the art. Further, the inlet passages 68 may have diameters of approximately 0.01, 0.02, 0.03, 0.04, 0.05, 0.06, 0.07, 0.08, 0.09, or 0.10 inches or, in other embodiments, less than 0.01 inches or greater than 0.10 inches.

The inlet passages 68 may be configured to provide a portion 84 (see FIG. 5) of the air flow 72 to the downstream end portion 52 of the combustor liner 34. Further, an inner surface 55 of the annular wrapper 54 and channels 56 defined in the downstream end portion 52 may form passages to receive the air flow 84 provided via the inlets 68. For example, in one embodiment, each inlet 68 may supply an air flow 84 by diverting a portion of the air flow 72 flowing upstream towards the fuel nozzles 20 through air flow paths 36 and 47 to a respective channel 56 defined in the downstream end portion 52. As the air flow 84, which is generally substantially cooler relative to the temperature of the hot gas flow 73 in the hot gas path 39 within the combustion chamber 38, flows into and through the channels 56, heat may be transferred away from the downstream end portion 52 of the combustor liner 34, thus cooling the downstream end portion 52 and the combustor liner 34. The combustor liner 34 may also includes bypass openings 41 which, as discussed above, may provide a cooling film along the inner surface of the combustor liner 34, thus providing additional insulation for the combustor liner 34.

Figure 4:
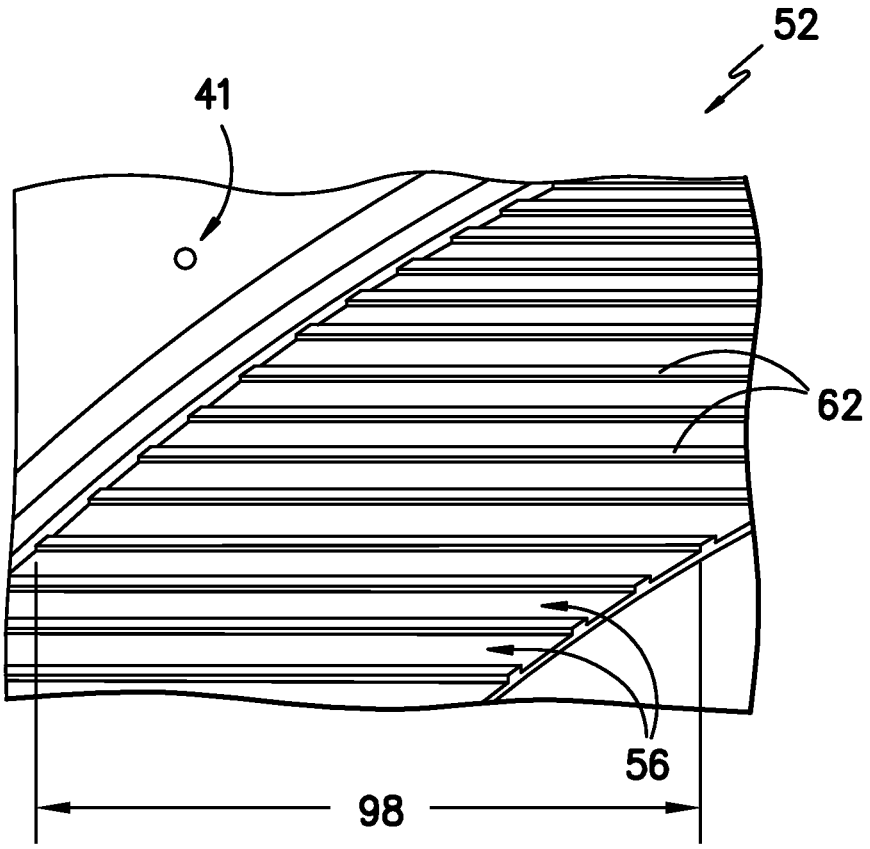
FIG. 4 is a partial perspective view of one embodiment of the combustor liner of the present disclosure within line 4-4 of FIG. 3.

FIG. 4 is a partial perspective view of the downstream end portion 52 of the combustor liner 34 within the circular region defined by the arcuate line 4-4 of FIG. 3. The downstream end portion 52 of the combustor liner 34 may define a plurality of channels 56. The plurality of channels 56 may be arranged circumferentially about the downstream end portion 52 of the combustor liner 34. In an exemplary aspect of an embodiment, the plurality of channels 56 may extend helically through the length L2 of the downstream end portion 52. For example, the plurality of channels 56 may extend helically through approximately the entire length L2 of the downstream end portion. Alternatively, however, the channels 56 may extend helically through only a portion of the length L2 of the downstream end portion 52, as shown in FIG. 8. Further, it should be understood that various of the channels 56 may extend helically through approximately the entire length L2, while other channels 56 may extend through only a portion of the length L2.

Each of the plurality of channels 56 may be configured to flow an air flow 84 therethrough, cooling the downstream end portion 52. For example, the channels 56 may define flow paths generally parallel to one another, the flow paths extending helically with respect to the length L2 and the longitudinal axis 58 of the combustor liner 34. In one embodiment, the channels 56 may be formed by removing a portion of the outer surface of the downstream end portion 52, such that each channel 56 is a recessed groove between adjacent raised dividing members 62. Thus, the channels 56 may be defined by alternating helical grooves and helical dividing members 62 about a circumference of the downstream end portion 52. As will be appreciated, the channels 56 may be formed using any suitable technique, such as milling, casting, molding, or laser etching/cutting, for example.

In an exemplary aspect of an embodiment, each of the plurality of channels 56 may have a length 98 that is greater than the axial length L2 of the downstream end portion 52. For example, the channels 56 may have lengths 98 of approximately 4, 8, 12, or 16 inches. In other embodiments, however, the channels 56 may have lengths 98 that are greater than 16 inches or less than 4 inches. The axial length L2 of the downstream end portion 52, however, may be approximately 3, 6, 9, or 12 inches. In other embodiments, however, the axial length L2 may be greater than 12 inches or less than 3 inches.

Alternatively, however, each of the plurality of channels 56 may have a length 98 that is substantially equal to, or less than, the axial length L2 of the downstream end portion 52. Further, it should be understood that various of the channels may have a length 98 that is greater than the axial length L2 while others have a length 98 that is substantially equal to, or less than, the axial length.

As shown in FIG. 6, each of the plurality of channels 56 may have a width 90. In one embodiment, for example, the channels 56 may each have a width 90 of approximately 0.25 inches, 0.5 inches, 0.75 inches, or 1 inch. In other embodiments, the width 90 may be less than 0.25 inches or greater than 1 inch. Further, in one embodiment, the width 90 of each of the channels 56 may be substantially constant throughout the length 98 of the channel. However, in another embodiment, the width 90 of each of the channels 56 may be tapered. For example, as shown in FIG. 9, the width 90 of each of the channels 56 may be reduced through the length 98 of the channel 56 in the direction of air flow 84 through the channel 56. Alternately, the width 90 of each of the channels 56 may be enlarged through the length 98 of the channel 56 in the direction of air flow 84 through the channel 56.

Each of the plurality of channels 56 may also have a depth 94. In one embodiment, for example, the depth 94 of the channels 56 may be approximately 0.05 inches, 0.10 inches, 0.15 inches, 0.20 inches, 0.25 inches, or 0.30 inches. In other embodiments, the depth 94 of the channels 56 may be less than 0.05 inches or greater than 0.30 inches. Further, in one embodiment, the depth 94 of each of the channels 56 may be substantially constant throughout the length 98 of the channel. However, in another embodiment, the depth 94 of each of the channel 56 may be tapered. For example, the depth 94 of each of the channels 56 may be reduced through the length 98 of the channel 56 in the direction of air flow 84 through the channel 56. Alternately, the depth 94 of each of the channels 56 may be enlarged through the length 98 of the channel 56 in the direction of air flow 84 through the channel 56.

The bypass openings 41 may provide an air flow 43 directly into the combustion chamber 38, thus providing an additional cooling film along the inner surface of the combustor liner 34, thereby further enhancing cooling of the combustor liner 34. In one embodiment, for example, the bypass openings 41 may have diameters of approximately 0.01, 0.02, 0.03, 0.04, 0.05, 0.06, 0.07, 0.08, 0.09, or 0.10 inches or, in other embodiments, less than 0.01 inches or greater than 0.10 inches.

Figure 5:
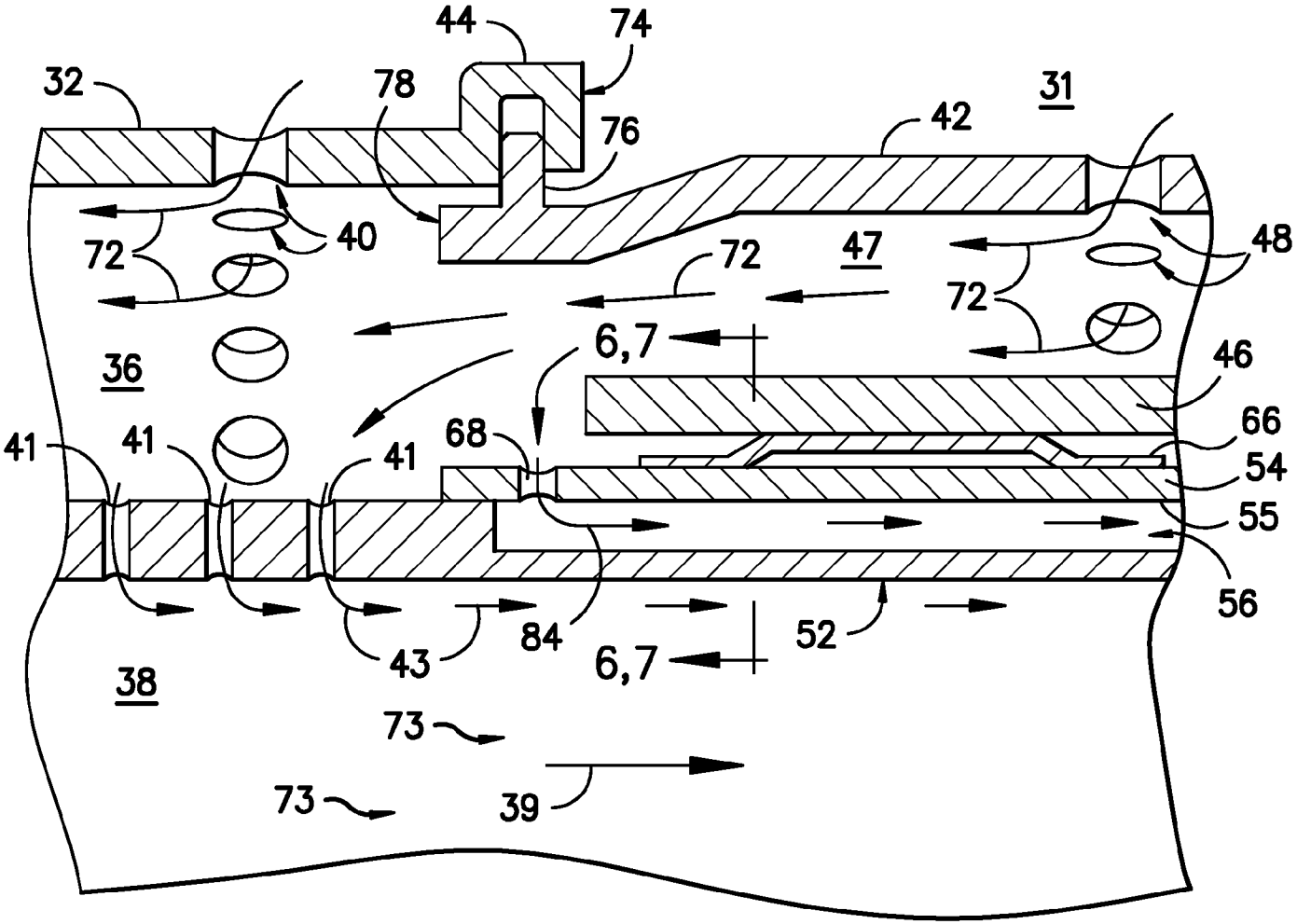
FIG. 5 is a partial cross-sectional view of one embodiment of various components of the combustor of the present disclosure within line 5-5 of FIG. 2.

Referring now to FIG. 5, a partial cross-sectional side view of the combustor 14 within the circular region defined by the arcuate line 5-5 in FIG. 2 is shown. Particularly, FIG. 5 shows in more detail the air flow 84 directed from the inlet passages 68 into and through the channels 56 defined on the downstream end portion 52 of the combustor liner 34, cooling the downstream end portion 52. As discussed above, air flow 72 discharged by the compressor 12 may be received in the air flow path 47, defined by the impingement sleeve 42 and the transition piece 46, through the inlets 48. In the present embodiment, the inlets 48 are circular-shaped holes, although in other implementations, the inlets 48 may be slots, or a combination of holes and slots of other geometries. As the air flow 72 within the air flow path 47 is channeled upstream relative to the direction of the hot gas path 39, the majority of the air flow 72 is discharged into the air flow path 36, defined by the flow sleeve 32 and the combustor liner 34. As discussed above, the flow sleeve 32 may include the mounting flange 44 at a downstream end 74 configured to receive a member 76 extending radially outward from the upstream end 78 of the impingement sleeve 42, thereby fluidly coupling the flow sleeve 32 and impingement sleeve 42. In addition to receiving the air flow 72 from the air flow path 47, the air flow path 36 may also receive a portion of the air flow 72 from the discharge plenum 31 by way of the inlets 40. Thus, the air flow 72 within the air flow path 36 may include air flow 72 discharged from the annular passage 47 and air flow 72 flowing through the inlets 40. Thus, an air flow path that is directed upstream with respect to the hot gas path 39 is defined by the air flow paths 36 and 47. Additionally, it should be understood that, like the inlets 48 on the impingement sleeve 42, the inlets 40 may also include holes, slots, or a combination thereof, of various shapes.

While a majority of the air flow 72 flowing through the air flow path 47 is discharged into the air flow path 36, a portion 84 of the air flow 72 may be provided to the downstream end portion 52 of the combustor liner 34. For example, as the air flow 72 flows through the combustor 14, discharge plenum 31, and air flow paths 36 and 47, the inlet passages 68 may be configured to accept at least a portion 84 of the air flow 72 from the combustor 14, discharge plenum 31, and air flow paths 36 and 47, as discussed above. The inlet passages 68 may provide this portion of the air flow 84 to the downstream end portion 52 of the combustor liner 34. As discussed above, the portion 84 of the air flow 72 may be directed from the inlet passages 68 through the channels 56 on the downstream end portion 52 of the combustor liner 34, cooling the downstream end portion 52. Though only one channel 56 is shown in the cross-sectional view of FIG. 5, it should be understood that a similar air flow scheme may be applied to each of the channels 56 on the downstream end portion 52. In one embodiment, the total air flow 84 directed into and through the channels 56 about the downstream end portion 52 may represent approximately 1, 2, 3, 4, 5, 6, 7, 8, 9, or 10 percent of the total air flow 72 supplied to the combustor 14. In other embodiments, the total air flow 84 directed into the channels 56 may be more than 10 percent or less than 1 percent of the total air flow 72 supplied to the combustor 14.

As discussed above, the air flow 84 that is provided to the channels 56 may be generally substantially cooler relative to the hot gas flow 73 in the hot gas path 39 within the combustion chamber 38. Thus, as the air flow 84 flows through the channels 56, heat may be transferred away from the combustor liner 34, particularly the downstream end portion 52 of the combustor liner 34. By way of example, the mechanism employed in cooling the combustor liner 34 may be forced convective heat transfer resulting from the contact between the air flow 84 and the outer surface of downstream end portion 52, which may include the grooves and dividing members 62 defining the channels 56, as discussed above. The cooling air 84 may flow in a generally helical direction through the channels 56 along the length of the downstream end portion 52. Because the air 84 flows in a generally helical direction through the channels 56, and because the length of the channels 56 is generally longer than the axial length L2 of the downstream end portion 52, the residence time of the air flow 84 within the channels 56 is increased, resulting in increased cooling of the downstream end portion 52. The air flow 84 may then exit the channels 56, thereby discharging into the transition piece cavity 50. The air flow 84 may then be directed towards and mix with the hot gas flow 73 flowing downstream through hot gas path 39 from combustion chamber 38 through transition piece cavity 50.

Additionally, FIG. 5 illustrates the use of multiple sets of bypass openings 41. For instance, referring back to the embodiment shown in FIGS. 3 and 4, a single set of bypass openings 41 disposed circumferentially about the combustor liner 34 is illustrated. As shown in FIG. 5, three such sets of axially spaced bypass openings 41 may be utilized in cooling the combustor liner 34. That is, each of the bypass openings shown in the cross-sectional view of FIG. 5 may correspond to a respective set of bypass openings arranged circumferentially about the combustor liner 34. A portion 43 of the air flow 72 from the air flow path 36 may flow through each of the bypass openings 41 into the combustion chamber 38. As discussed above, this air flow 43 may provide a cooling film, thus further improving the insulation of the combustor liner 34 from the hot gas flow 73 within the combustion chamber 38. It should be understood that the sets of bypass openings 41 are not limited to one set or three sets, but may be two sets, four sets, or any other number or variety of sets.

As shown in FIG. 6, in one embodiment, each of the plurality of channels 56 of the present disclosure may have a substantially smooth surface, such as a substantially smooth channel surface 95 and sidewalls 92. For example, the channel surface 95 and sidewalls 92 of each of the channels 56 may be substantially or entirely free of protrusions, recesses, or surface texture. As air flow 84 flows through the channels 56 in the generally downstream direction and contacts the channel surface 95 and sidewalls 92 of each channel 56, heat may be transferred away from the combustor liner 34, particularly the downstream end portion 52 of the combustor liner 34, via forced convection cooling.

As shown in FIG. 7, in an alternative embodiment, each of the plurality of channels 56 of the present disclosure may have a surface, such as channel surface 95 and sidewalls 92, that includes a plurality of surface features 96. The surface features 96 may be discrete protrusions extending from the channel surface 95 or sidewalls 92. For example, the surface features may include fin-shaped protrusions, cylindrical-shaped protrusions, ring-shaped protrusions, chevron-shaped protrusions, raised portions between cross-hatched grooves formed within the channel 56, or some combination thereof, as well as any other suitable geometric shape. It should be appreciated that the dimensions of the surface features 96 may be selected to optimize cooling while satisfying the geometric constraints of the channels 56. The surface features 96 may further enhance the forced convective cooling of the combustor liner 34 by increasing the surface area of the downstream end portion 52 which the cooling air flow 84 may contact as it flows through the channel 56. Thus, as the air flow 84 flows through the channels 56 and contacts the surface features 96, the amount of heat transferred away from the combustor liner 34 may be greater relative to the embodiment shown in FIG. 6. Further, while the presently illustrated embodiments show surface features 96 formed only on the channel surface 95, in other embodiments, the surface features 96 may be formed only on the sidewalls 92 of the channel 56, or on both the surface 95 and sidewalls 92 of the channel 56.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor liner comprising:

an upstream portion having a radius and a length along a generally longitudinal axis, the upstream portion defining a plurality of bypass holes; and a downstream end portion having a radius and a length along the generally longitudinal axis, the downstream portion extending downstream from the plurality of bypass holes in an air flow direction, an outer surface of the downstream end portion defining a plurality of channels, each of the plurality of channels defined only in the downstream end portion and extending helically through the length of the downstream end portion, wherein each of the plurality of channels is configured to flow an air flow therethrough, cooling the downstream end portion, and wherein the radius of at least a portion of the downstream end portion is less than the radius of the upstream portion.

2. The combustor liner of claim 1, wherein each of the plurality of channels extends helically through approximately the entire length of the downstream end portion.

3. The combustor liner of claim 1, wherein each of the plurality of channels extends helically through only a portion of the length of the downstream end portion.

4. The combustor liner of claim 1, wherein each of the plurality of channels has a length greater than the length of the downstream end portion.

5. The combustor liner of claim 1, wherein each of the plurality of channels has a width, and wherein the width of each of the plurality of channels is substantially constant throughout the length of the channel.

6. The combustor liner of claim 5, wherein the width of each of the channels is in the range from approximately 0.25 inches to approximately 1 inch.

7. The combustor liner of claim 1, wherein each of the plurality of channels has a width, and wherein the width of each of the plurality of channels is reduced through the length of the channel in the direction of the air flow through the channel.

8. The combustor liner of claim 1, wherein each of the plurality of channels has a substantially smooth surface.

9. The combustor liner of claim 1, wherein each of the plurality of channels has a surface that includes a plurality of surface features.

10. The combustor liner of claim 1, wherein each of the plurality of channels has a depth, and wherein the depth of each of the plurality of channels is substantially constant throughout the length of the channel.

11. The combustor liner of claim 10, wherein the depth is in the range from approximately 0.05 inches to approximately 0.3 inches.

12. The combustor liner of claim 1, wherein each of the plurality of channels has a depth, and wherein the depth of each of the plurality of channels is reduced through the length of the channel in the direction of the air flow through the channel.

13. The combustor liner of claim 1, wherein the length of each of the plurality of channels is in the range from approximately 4 inches to approximately 16 inches.

14. The combustor liner of claim 1, wherein the length of the downstream end portion is in the range from approximately 3 inches to approximately 12 inches.

15. The combustor liner of claim 1, wherein the length of the downstream end portion is less than the length of the upstream portion.

16. The combustor liner of claim 1, wherein the radius of the downstream end portion is generally less than the radius of the upstream portion.

17. The combustor liner of claim 1, wherein the radius of the downstream end portion is reduced throughout the length of the downstream end portion in the direction of the air flow through the plurality of channels.

18. The combustor liner of claim 1, wherein the radius of the upstream portion is reduced throughout a portion of the length of the upstream portion in the direction of the air flow through the plurality of channels.

19. A combustor comprising:

a combustor liner at least partially defining a hot gas path, the combustor liner including an upstream portion and a downstream end portion, the upstream portion defining a plurality of bypass holes, the upstream portion and the downstream end portion each having a radius and a length along a generally longitudinal axis, the downstream portion extending downstream from the plurality of bypass holes in an air flow direction, and wherein the radius of at least a portion of the downstream end portion is less than the radius of the upstream portion;

a transition piece coupled to the combustor liner and further defining the hot gas path; and an annular wrapper disposed between the combustor liner and the transition piece, the annular wrapper defining a plurality of inlet passages, the plurality of inlet passages configured to provide an air flow to the downstream end portion of the combustor liner, wherein an outer surface of the downstream end portion of the combustor liner defines a plurality of channels, each of the plurality of channels defined only in the downstream end portion and extending helically through the length of the downstream end portion, and wherein the air flow is directed from the inlet passages through the plurality of channels, cooling the downstream end portion.

20. The combustor of claim 19, wherein each of the plurality of channels has a length greater than the length of the downstream end portion.

* * * * *